US008212640B1

(12) United States Patent
Tuschner

(10) Patent No.: US 8,212,640 B1
(45) Date of Patent: Jul. 3, 2012

(54) TOOL HAVING BUFFERED ELECTROMAGNET DRIVE FOR DEPTH CONTROL

(75) Inventor: Jerome Tuschner, Orlando, FL (US)

(73) Assignee: Lockheed Martin Corporation

( * ) Notice: Subject to any disclaimer, the term of this patent is extended or adjusted under 35 U.S.C. 154(b) by 0 days.

(21) Appl. No.: 13/191,112

(22) Filed: Jul. 26, 2011

(51) Int. Cl.
*H01F 7/00* (2006.01)
*H01F 7/08* (2006.01)

(52) U.S. Cl. ..... 335/229; 335/219; 335/228; 335/230; 335/234; 335/241; 335/255; 335/256; 335/261; 335/266; 335/268; 335/279

(58) Field of Classification Search ..... 335/219, 335/266, 220, 222, 225, 228–230, 234, 241, 335/253–256, 261, 268, 272, 279
See application file for complete search history.

(56) References Cited

U.S. PATENT DOCUMENTS

| | | | | |
|---|---|---|---|---|
| 3,001,115 | A * | 9/1961 | Gendren et al. | 318/137 |
| 3,070,730 | A * | 12/1962 | Gray et al. | 335/229 |
| 3,202,886 | A * | 8/1965 | Kramer | 335/234 |
| 3,570,353 | A | 3/1971 | Hess | |
| 4,422,060 | A * | 12/1983 | Matsumoto et al. | 335/256 |
| 4,533,890 | A * | 8/1985 | Patel | 335/234 |
| 4,928,028 | A * | 5/1990 | Leibovich | 310/23 |
| 5,434,549 | A * | 7/1995 | Hirabayashi et al. | 335/229 |
| 5,797,360 | A * | 8/1998 | Pischinger et al. | 123/90.11 |
| 6,472,968 | B1 * | 10/2002 | Ohya | 335/229 |
| 6,502,488 | B1 | 1/2003 | Taylor | |
| 6,876,284 | B2 * | 4/2005 | Wright et al. | 335/229 |
| 7,222,554 | B2 * | 5/2007 | Hayashi et al. | 74/473.12 |
| 2003/0061921 | A1 | 4/2003 | Chen et al. | |
| 2005/0046531 | A1 * | 3/2005 | Moyer et al. | 335/256 |
| 2006/0130785 | A1 * | 6/2006 | Han et al. | 123/90.11 |
| 2007/0257756 | A1 * | 11/2007 | Matsumoto et al. | 335/229 |
| 2011/0001591 | A1 * | 1/2011 | Puth et al. | 335/229 |

FOREIGN PATENT DOCUMENTS

| | | |
|---|---|---|
| CN | 1347787 | 5/2002 |
| GB | 751456 | 6/1956 |

OTHER PUBLICATIONS

Wolfram Ulrich et al, "Cutting Curves Not Corners", www.machinedesign.com, May 10, 2007.

* cited by examiner

*Primary Examiner* — Mohamad Musleh
(74) *Attorney, Agent, or Firm* — Jeffer & Associates, P.A.

(57) ABSTRACT

A magnetically driven tool includes a shaft having a bottom application end including a contacting surface, at least one support around a portion of the shaft for supporting components positioned outside the shaft that float with respect to the shaft. A first magnet is affixed to the shaft. An electromagnet secured to the support is positioned outside the shaft and floats with respect to the shaft above the first magnet. At least one bearing is provided for sliding the shaft in an axial direction and optionally rotating the shaft. For pushing operations, the direction of current through the electromagnet is applied so that like poles relative to the first magnet face one another to provide a repulsive force, while for pulling operations unlike poles face one another. The magnitude of the current sets a force applied by the contacting surface to a workpiece.

20 Claims, 3 Drawing Sheets

TOOL HAVING BUFFERED ELECTROMAGNET DRIVE FOR DEPTH CONTROL

STATEMENT REGARDING FEDERALLY SPONSORED RESEARCH

The subject invention was made with U.S. government support under Contract Nos. LRIP 2- N00019-07-C-0097 and LRIP 3 - N00019-08-C-0028 with the U.S. Navy. The U.S. Government has certain rights in this invention.

FIELD

Disclosed embodiments relate to magnetically driven tools that include structures for providing improved depth (axial position) control.

BACKGROUND

Conventional commercial robot-based cutters and assembly apparatus provide x, y and z position control of no better than about 0.005" (0.177 mm). Many cutter and assembly applications can benefit from improved position control and improved capability, particularly in the z (axial) dimension. It is particularly important when force control or a gentle "touch" is required.

SUMMARY

Disclosed tools include closed loop force and positional sensors in the z dimension to improve dimensional control by sensing the surface and then using that dimension to control an action by either a programmed increase in force or by monitoring and controlling the position of the end effector. Disclosed tools are therefore capable of upgrading older, less accurate machines as well as providing force control enhancement to even precision tolerance new equipment. Disclosed tools also provide rapid temporary and/or permanent force control variations and isolation to improve automated equipment.

Disclosed embodiments include magnetically driven tools comprising a moveable shaft having a bottom application end including a contacting surface, at least one support (e.g., a housing) around a portion of the shaft for supporting components positioned outside the shaft that float with respect to the shaft. The top end of the shaft is physically unconnected. A first magnet is affixed to the shaft. An electromagnetic device (including electromagnets, linear motors, voice coil motor, etc.) secured to the support is positioned outside the shaft and floating with respect to the shaft above the first magnet.

The tool includes at least one bearing contacting the shaft for sliding the shaft with low friction in an axial direction, and optionally also rotating the shaft with low friction. In one embodiment upper bearings are attached to the support above the electromagnet and lower bearings are attached to the support. For pushing operations, for example, the direction of current through the electromagnet is applied so that like poles relative to the first magnet face one another (N-N or S-S) to provide a repulsive magnetic force between the electromagnet and first magnet, which due to the first magnet being affixed to the shaft forces the shaft downward. For pulling operations, the direction of the current is reversed relative to the direction for pushing operations. The magnitude of the current thus sets the magnitude of the force applied by the contacting surface, typically with an attachment thereon, to a workpiece.

In one embodiment a second magnet is included between the first magnet and the lower bearings outside the shaft, that floats with respect to the shaft. The first magnet and second magnet can be configured so that like poles face one another to provide another repulsive magnetic force that is between the first magnet and the second magnet. This embodiment results in opposing magnetic forces (upper magnetic force from above and lower magnetic force from below) applied to the first magnet and thus to the shaft, for pushing operations with the upper repulsive magnetic force pushing down and the lower magnetic force pushing up on the first magnet/shaft. Advantages of this embodiment include each set of magnets forcing a gap (cushion) for both up and down movement of the shaft. Using this embodiment for an example cutting application, when a load is applied the cutting surface (e.g., knife) compresses the gap/cushion and contacts the workpiece surface. As soon as current is stopped to the electromagnet, the cutting surface automatically springs back to a "center" position that is no longer in surface contact with the workpiece.

The support or housing associated with disclosed tools can be attached to a control device, such as a robotic arm, or more generally to any computer controlled machine (e.g., computer numerical control (CNC) machine). Disclosed tools have been found to provide substantial improvements in the ability to repeatably obtain precise axial (z) positions, such as within 0.001", which is about a 5× improvement over the axial position precision provided by commercial robot-based cutters.

DETAILED DESCRIPTION

Figure 1:
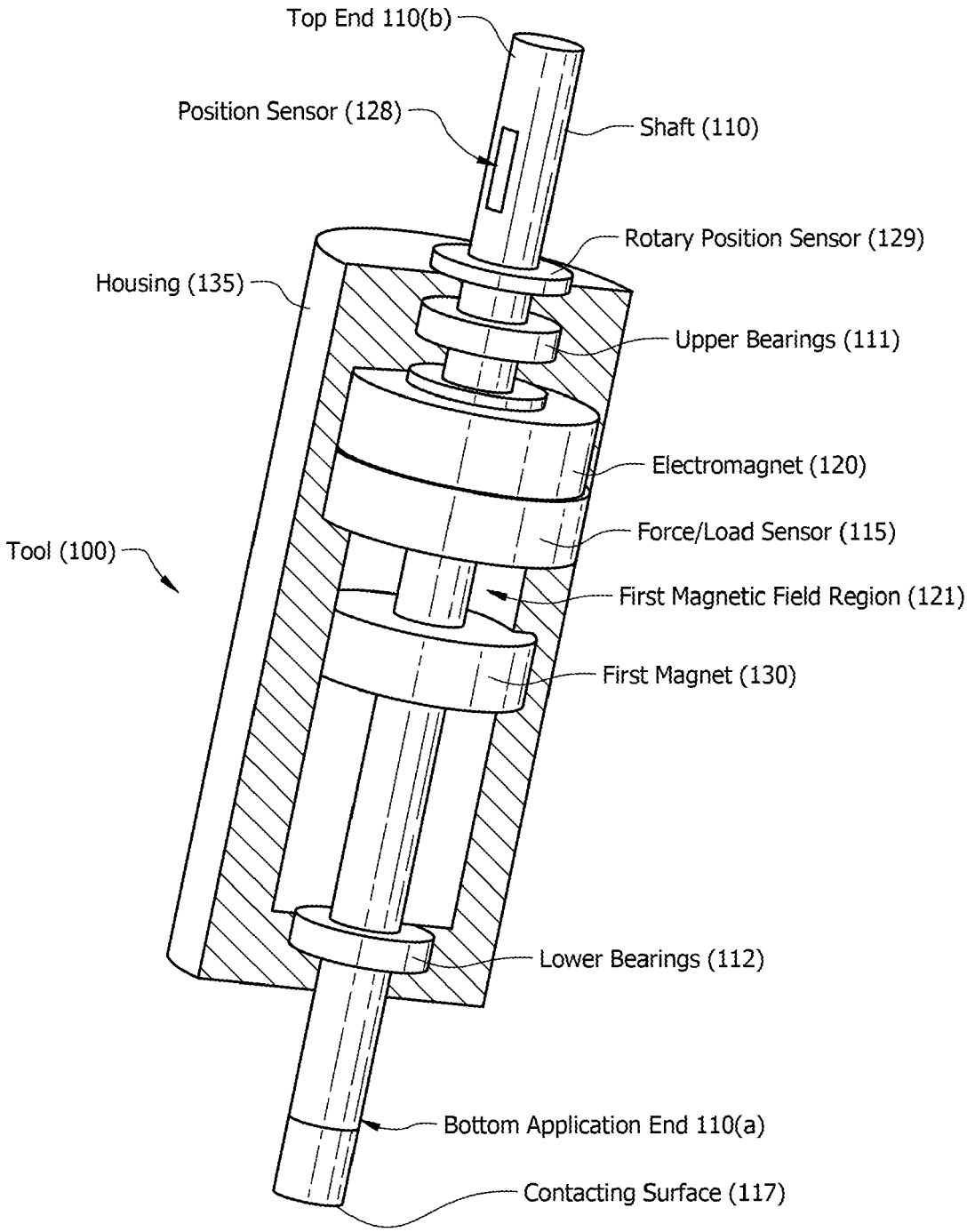
FIG. 1 is a depiction of an example magnetically driven tool, according to an example embodiment.

Disclosed embodiments are described with reference to the attached figures, wherein like reference numerals, are used throughout the figures to designate similar or equivalent elements. The figures are not drawn to scale and they are provided merely to illustrate aspects disclosed herein. Several disclosed aspects are described below with reference to example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. Disclosed embodiments are not limited by the illustrated ordering of acts or events, as some acts may occur in different orders and/or concurrently with other acts or events. Furthermore, not all illustrated acts or events are required to implement a methodology in accordance with this Disclosure.

FIG. 1 is a depiction of an example magnetically driven tool 100, according to an example embodiment. The support shown as a housing 135 is cut open to reveal components inside the housing 135 that are associated with the shaft 110.

Shaft 110 has a bottom application end 110(*a*) including a contacting surface 117 shown as one end of the shaft itself, that typically includes an attachment secured thereto. Shaft includes a top end 110(*b*). The shaft 110 is formed from an appropriate material, and with a sufficiently large enough cross sectional area dimension to be rigid enough to avoid measurable flexure. The material for the shaft 110 can comprise a non-magnetic permeable metal (or metal alloy) or low magnetic permeable metal (or metal alloy), such as certain low magnetic permeable steels. The shaft 110 can have various cross sectional shapes, including for example round, rectangular and square.

In operation of tool 100, the top end 110(*b*) of the shaft 110 remains physically unconnected/free, while the shaft 100 slides in the axial direction upward and downward enabled by bearings 111, 112, which also enables rotation in the x-y plane if desired. There are thus no "hard" contacts to anywhere on the shaft 110 to provide isolation and low friction while under load. The tool 100 uses a controlled (e.g., programmed) current to its electromagnet 120 to generate the desired axial force on the shaft 110 through application of a repulsive magnetic force oriented in the downward direction for moving the shaft downward. Accordingly, the shaft 110 may axially extend and provide its contacting surface 117 or attachments thereon (a knife) to a preselected or a variable force based solely on the applied current. This force can be regulated by electronic control and can be continuously monitored and/or be controlled by addition of a sensing/measurement device, such as the force/load sensor 115 shown in FIG. 1. Although force/load sensor 115 is shown positioned between electromagnet 120 and first magnet 130, force/load sensor 115 can be positioned in other locations, such as between electromagnet 120 and upper bearings 111.

Tool 100 comprises at least one support shown in FIG. 1 as a housing 135 which is positioned around a portion of the shaft 110 for supporting components positioned outside the shaft 110 that float with respect to the shaft 110 including electromagnet 120, the force/load sensor 115, as well as for supporting upper bearings 111 and lower bearings 112. Housing 135 also encloses first magnet 130. Although the support is shown in FIG. 1 as a housing 135 that is a single piece which provides an enclosure for the components inside, the support can comprise a plurality of separate pieces, and need not provide an enclosure. For embodiments that comprise bearings 111, 112 that include lubricants, the support will generally enclose the bearings to avoid dirt/dust accumulation on the bearings during operation of tool 100.

Tool 100 includes at least one bearing contacting the outer surface of the shaft 120 for sliding the shaft in an axial direction and optionally also rotating the shaft in the x-y plane, shown as upper bearings 111 attached to the housing 135 above the electromagnet 120, and lower bearings 112 attached to the housing 135 below the first magnet 130. The bearings 111 and 112 allow free rotation (360 degrees) for the shaft 110, such as while the tool 100 moves over a prescribed path with a minimum of x/y tolerances. The bearings 111, 112 also have low friction in the axial (z) direction so that a low force/pressure to a workpiece can be accurately applied. The upper bearings 111 and lower bearings 112 thus provide the shaft 110 with axial and/or rotational movement with low friction to aid with location precision.

A wide range of bearings and/or bearing materials can generally be used for bearings 111, 112 that provide a range of performance. "Zero" gap sliding bearings will provide essentially no contribution to x/y dimensional accuracy under load, but will have relatively high rotational and sliding friction. Precision air or magnetic bearings can provide essentially zero rotational or sliding friction. The bearings 111, 112 can include a lubricant, such as an oil.

In the lubricated bearing embodiment, the inner dimension of the upper bearing 111 and lower bearing 112 both generally exceed an outer dimension of the shaft 110 to provide an inner and an upper bearing gap. The lubricant in this embodiment fills the upper bearing gap and lower bearing gap.

As noted above, disclosed tools can include only a single bearing. In this single bearing embodiment, a long bearing is used that can provide fairly good control of dimensions in the x/y direction when the load is small, such as may be encountered in a marking or assembly operation where the only distorting forces are the acceleration/deceleration as the tool is positioned to the desired x/y position. In that case, if the axial load is positioned close to perpendicular then essentially no force exists to change the x/y position.

The first magnet 130 within the housing 135 is affixed to the shaft 110. The first magnet 130 can comprise an electromagnet or a permanent magnet. Electromagnet 120 is secured to the housing 135, is positioned outside the shaft 110, and floats with respect to the shaft 110 above the first magnet 130. When electromagnet 120 is energized by application of current, a magnetic field is generated in the first magnetic field region 121. Although not shown in FIG. 1, a programmable computer controlled power supply can be coupled to the electromagnet 120 to provide a current to the electromagnet 120. For pushing operations, a direction of the current through the electromagnet 120 is applied so that like poles relative to the first magnet 130 face one another and a magnitude of the current sets a desired driving force applied by the contacting surface 117 or attachment secured thereto to a workpiece (not shown).

The direction of the current through the electromagnet 120 can also be applied to apply a controlled pulling force, or for switching between pulling and pushing. The current provided to the electromagnet 120 can be used to generate controlled oscillations, such as to simulate a knife or saw cutting action, or to simulate single or multiple "hammer blows" for insertion forces.

Tool 100 is shown including a position sensor 128 on the shaft 110. Position sensor 128 senses the axial/vertical position of the shaft 110. Although the position sensor 128 is shown mounted on the top end 110(*b*) of the shaft 110, the position sensor 128 is more generally mechanically coupled to the shaft 110, and thus can be mounted anywhere on the shaft 110, or any attachment to the shaft 110, or to features attached to the housing 135 or other support such as to a robot mount attached to the housing 135. Position sensor 128 can comprise a linear transducer in one embodiment. If optional rotary position sensor 129 shown in FIG. 1 is included, the circular rotation (x-y position) of the shaft 110 can be measured and thus controlled.

Figure 2:
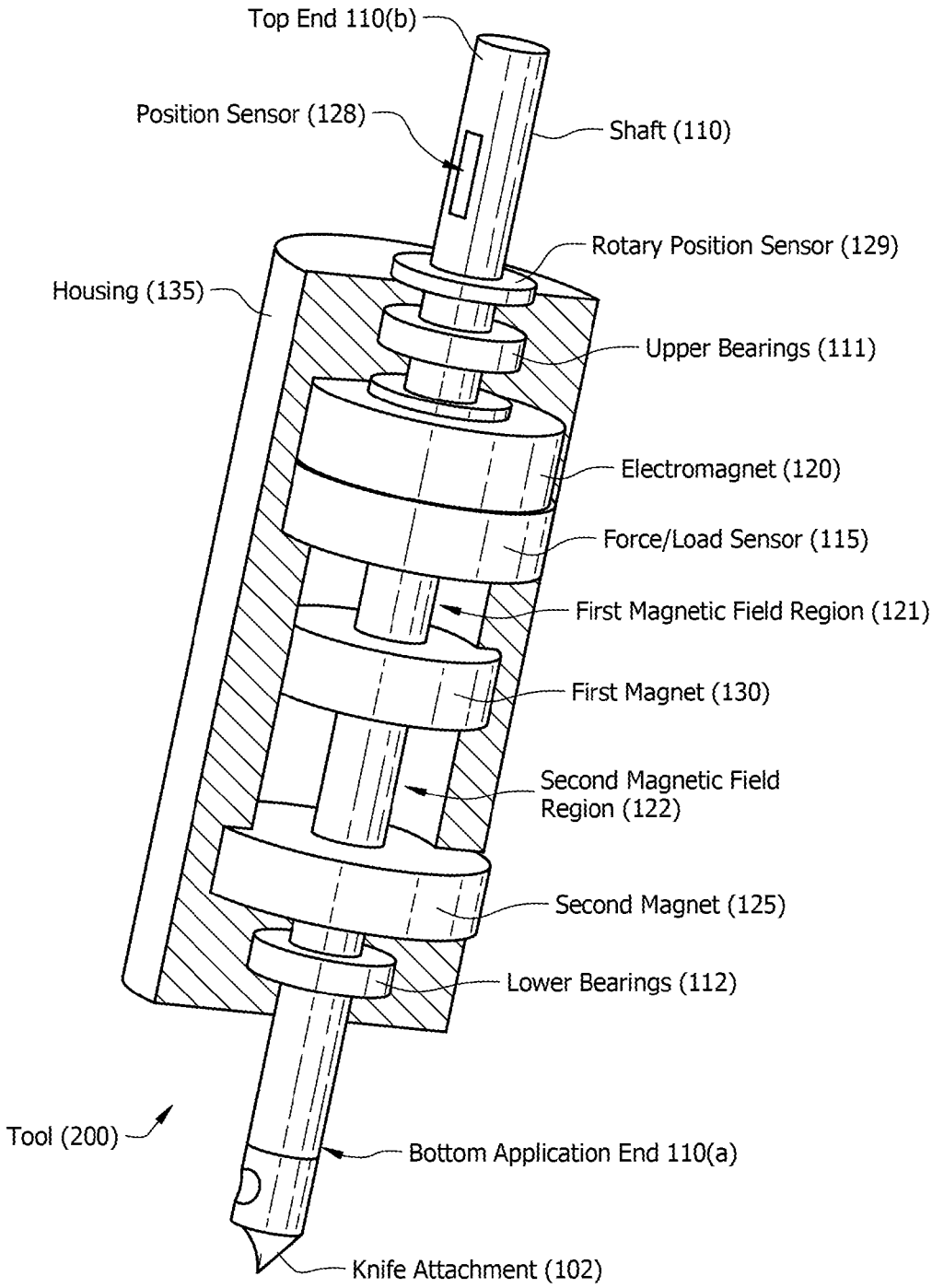
FIG. 2 is a depiction of an example magnetically driven tool according to another embodiment shown as a cutter that includes a contacting surface comprising a knife, according to an example embodiment.

FIG. 2 is a depiction of an example magnetically driven tool 200 that includes an attachment on the bottom application end 110(*a*) of shaft 110 shown as a knife 102, according to an example embodiment. Although not shown, a knife holder can be interposed between the bottom application end 110(*a*) and the knife 102. In this embodiment the bearings 111, 112 allow free rotation (360 degrees) for the shaft 110 as the knife 102 drags over a prescribed path with a minimum of x/y tolerances.

Tool 200 is shown including a second magnet 125 positioned between the first magnet 130 and the bottom end 110(*a*) of the housing that floats with respect to the shaft 110. The first magnet 130 and second magnet 125 can be positioned and biased (when an electromagnet is used for at least one of these magnets), so that like poles face one another creating an additional repulsive magnetic force for tool 200 as compared to tool 100 described above. This embodiment creates opposing magnetic forces on the top and bottom of the shaft 110. Each set of magnets (120/130 and 130/125) forces a gap (cushion stop) for both up and down movement of shaft 110. The additional magnetic interaction is provided in the second magnetic field region 122 when electromagnet 120 is energized, that is in addition to the interaction between electromagnet 120 and first magnet 130 in first magnetic field region 121. Second magnet 125 thus provides a magnetic buffer that maintains the axial position of the shaft/attachment on tool 200 in an approximately neutral position irrespective of the position of the tool 200. For tool 200 it provides buffering for the position of knife 102 shown in FIG. 2. In an alternate embodiment (not shown), the housing 135 may have a magnetic bottom portion comprising a magnetic material (instead of second magnet 125) to provide disclosed buffering including neutral position capability.

Buffering provided by second magnet 125 provides at least two functions. The additional magnetic interaction provided by adding second magnet 125 can balance the axial position of the shaft 110 automatically to provide near zero application pressure. As a result, second magnet 125 provides an automatic fail safe (safety) mechanism should a power fluctuation or disruption occur. If the tool 200 is positioned near the x/y plane with no power to the electromagnet 120 and then the electromagnet 120 is used to drive the tool to the surface and apply a desired pressure to that surface during x/y movement, then any interruption/malfunction can be used to cut the power to the electromagnetic 120 and thus return knife to the "safe" position. If the safety mechanism is tripped for any reason the contacting surface or attachment thereon (e.g., a knife), rapidly moves into a neutral position, which when set up correctly, will remove the contacting surface or attachment from the surface. In contrast, when used in the vertical position shown without second magnet 125, tool 100 has a minimum load which comprises the weight of the tool 100 minus the friction due to the bearings 111, 112.

Although tool 100 is described as having an electromagnet 120 and first magnet 130, and tool 200 having an electromagnet 120, first magnet 130 and second magnet 125, to increase load capability disclosed tools can include additional magnets or be configured in other configurations. For example, tool 200 can be configured as a double driver with two electromagnets by embodying second magnet 125 as an electromagnet. If the current applied to electromagnet 120 and second magnet 125 embodied as an electromagnet is such that second magnet 125 pulls the shaft 110 and electromagnetic 120 pushes the shaft 110, tool 200 can provide an enhanced net force equal to the sum of the respective magnetic forces, such as a 2× force application (for equal magnitude magnetic forces) when desired, or the buffered design described above just by changing (switching) the current polarity to second magnet 125. In a push/pull application this could dramatically increase the force available. This double driver concept could potentially reduce the cost and increase the longevity of current tools such as a sawzalls whereby essentially all components are eliminated by replacement with two disclosed electromagnetic drivers.

Moreover, additional bearings and additional sensors can be provided. For example, additional fail safe features can be added, such as but not limited to, an excess speed sensing device, excess movement control sensor, and an overpressure device that can be attached to power disconnect circuitry. Disclosed tools can also include load cells in the bearing area(s) to allow measurement and thus control of applied x/y forces for protective safety stops as described above.

In operation of disclosed tools, the top end 110(*b*) of the shaft remains physically unconnected, while the support such as housing 135 can be coupled to a computer controlled device. The computer controlled device can comprise a CNC machine, such as a commercial robot to provide x-y movement (e.g. rotation) of the shaft 110, and provide control signals to control the current to the electromagnet 120 to control the axial position of the shaft 110. The control device does not have any direct physical contact to the shaft 110 thus isolating the tool from any undesirable inherent harmonic vibration movements in the axial direction of the attachment machinery.

Precision applied forces are achieved during operation of disclosed tools. When the tool includes 2 magnetic fields, such as provided by tool 200 as disclosed above, the force on the surface of the workpiece is the total force applied by the magnetic field minus the calibration forces needed to compress the magnetic fields in any given position. When the tools includes a single magnetic field, such as tool 100, the calibration force is the weight of the shaft plus the tool minus friction. Since the calibration forces change when the tool is oriented other than a 90 degree position, there will generally be calibration curve(s) for non-vertical applications.

Figure 3:
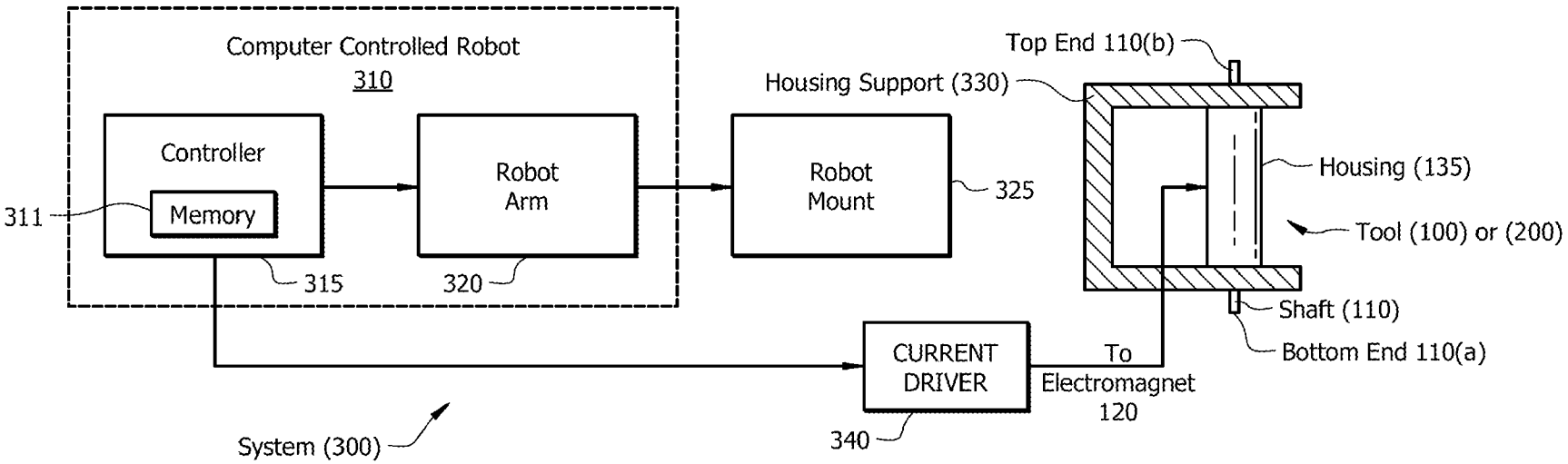
FIG. 3 is a block diagram comprising depiction of an example computer controlled magnetically driven tool system, according to an example embodiment

FIG. 3 is a block diagram depiction of an example computer controlled magnetically driven tool system 300, according to an example embodiment. System 300 includes a computer controlled robot 310 that comprises a controller 315 that controls the movement of a robot arm 320 and provides control signals that control a current driver 340 that provides a programmed current to the electromagnet 120.

Controller 315 includes associated memory 316 that stores appropriate software to interface with and control the various functions provided by the tool. The software can include additional software to interface with commercial robotic software to control the tool and provide over pressure/position safety features. The software can include code that is operable for providing the current to electromagnet 120 to achieve a predetermined force, and code comprising stored data including a pressure vs. depth curve for at least one material in the workpiece. In the case of cutting optical coatings over an optical window, curves can be provided for the various materials, such as for a soft coating material, for a medium hardness primer material, and a hard material such as a very hard optical window. The software can control the cut to only reach the primer, and not contact the optical window. Robot arm 320 is secured to a robot mount 325, such as a universal robot mount. As disclosed above, for applications where the tool contacts the workpiece at an angle other than 90 degrees, calibration curves are generally provided to account for the angle of contact for such non-vertical applications.

The robot mount 325 is shown secured to a housing support 330. Housing 135 is shown held by housing support 330 but may, if space and weight are acceptable, be secured directly to the robot mount 325. Top end 110(*b*) and bottom end 110(*a*) of the shaft 110 are shown extending beyond the housing support 330 but as disclosed above are never in direct contact with robot 325 in the axial dimension due to the ability of the shaft 110 to slide with low friction and the buffering from the magnetic field, thus not a direct influence on the forces to the surface where work is performed. Thus any vibrations in the axial dimensions are uncoupled from the robot 325. X/Y harmonics may still be affected because of the close contact through the bearings. The housing support 330 can include an end effector to isolate the tool 100 or 200 from the normal harmonics of the robot mount 325 or other mounting device. Top end 110(*b*) is physically unconnected.

For embodiments that include rotation, shaft rotation can be provided in a variety of different arrangements, that are described below with respect to a cutting application using a knife. In one embodiment disclosed tools are free to rotate essentially friction free with respect to the housing 135 (or other support). In the case of a freeform cutter that has it's tip at least slightly off center to the shaft, the knife works by being drawn across some material which causes the knife to orient itself along the travel path sharp edge forward. Any device with friction drag along the x/y plane needs to rotate as it follows complex paths controlled by robot or CNC machinery, and to do so with as little friction as possible. It is important especially as the axial load is increased by the magnetic driver. Tools described herein have almost zero rotational friction even under high load as there is no physical contact with the loading source.

In a second locked-shaft embodiment the shaft 110 may be rotationally anchored to the housing 135 (or other support) such that CNC equipment controls the rotation of the shaft, or lack thereof, by turning the housing through the prescribed rotational movements. In another embodiment an additional controlled power source such as a DC/AC or pneumatic driver can be attached to the housing 135 (or other support) to provide low to high speed rotational control and movement, such as in a torque application or a grinding operation while maintaining a programmed axial load over relatively large axial travel.

In one particular embodiment, the control device is a commercially available high tolerance robot capable of 6 dimensional operation. An attachment such as a knife 102 can be controlled by a robot and interfaced with its software such that the robot controls the knife 102 to high precision, and the tool can further automatically measure and adjust the position of the knife 102, or other attachment, based on the measurements and capabilities built into disclosed tools.

Numerous embodiments and other uses for disclosed tools are possible. For example, disclosed tools can be designed with contacting surfaces having attachments on each end of the shaft (110(*a*), 110(*b*)). One or both ends could be fixed, free rotating or powered and the other end selectively fixed depending on shaft position or electronic brake.

Embodied with a robot/CNC, disclosed tools can convert a robot/CNC to an accurate z measurement device. In one application, disclosed tools can be used to determine where the position of an actual surface of a part/tool is relative to a theoretical known spot in free space. The difference can then be calculated, manipulated and stored for QC purposes or could cause an action to occur based on that precise position. An example is an assembly operation where tooling dimensional variations cause either hard, non contact or flush installation variables detrimental to the assembly. If this is a driven tool then both torque and pressure may be measured thus providing real time tool monitoring or torque recording. If this is an insertion tool then installed flush/recessed fasteners position can be measured or recorded.

Disclosed tools can also be adapted for a variety of "hand" held tools, such as common drills, sawzalls, staplers, nailers. With miniaturized electronics it is easy to measure, manipulate and control data in tiny packages such that even complicated electronics can be incorporated into hand tool designs. With appropriate extensions/enclosures, for example, deep (e.g., 2" (5.08 centimeters)) holes can be drilled and/or fasteners installed "flush" with highly accurate repeatability.

Applications for disclosed tools are numerous. One application is for stencil cutting machines or other flat computer controlled cutting devices that can benefit from the enhanced cutting depth accuracy, blade monitoring and increased capability over conventional cutting devices. The ability to provide both force/pressure and movement control can be used to cut composite prepreg plies either on the mold or directly on a complex layup without damaging the next ply. Aerospace manufacturers that are using thick, specialized coatings may find improved cutters based on disclosed tools useful. Those same coating may require sanding/fairing over complex shapes whereby a sanding attachment capable of having pressure control over significant axial movement is desirable. Disclosed holder designs can also be used to upgrade old, large or inaccurate robots to apply very precise "touch" capability. For example, one embodiment is to use the force gauge readings to interface with the robot movements directly (no separate electromagnetic control) such that the robot would use the compression magnetic fields with the force gauge to control axial movement with a relatively consistent controllable force value instead of the hard dimensional data now used that most times either misses the surface or contacts it with great force.

Disclosed tools can also be used to apply a high precision controlled pressure (no cutter). This embodiment has applications for electronic assembly (e.g., thermo-compression bonding (TC) bonding for integrated circuit (IC) assembly). Instead of needing to control the robot or tooling dimensions very accurately when assembling small devices to achieve pressure, disclosed tools allow less expensive tooling and programming to set the pressure and the magnetic buffering can provide significantly more accuracy and hence forgiveness in a manufacturing environment.

Disclosed tools can be tailored for specific applications by selecting appropriate magnets and shafts. An example cutting application may use a maximum force of about 1.75 pounds and include a shaft of ½ inch diameter, or less. Electromagnets are capable of being manufactured from a few grams to many pounds. Likewise the strength of the permanent magnetic fields can be tailored by selection of size and/or material. Disclosed tools can also include a linear motor, Voice Coil Motor, etc. to significantly increase travel in the z direction when desired.

While various disclosed embodiments have been described above, it should be understood that they have been presented by way of example only, and not as a limitation. Numerous changes to the disclosed embodiments can be made in accordance with the Disclosure herein without departing from the spirit or scope of this Disclosure. Thus, the breadth and scope of this Disclosure should not be limited by any of the above-described embodiments. Rather, the scope of this Disclosure should be defined in accordance with the following claims and their equivalents.

Although disclosed embodiments have been illustrated and described with respect to one or more implementations, equivalent alterations and modifications will occur to others skilled in the art upon the reading and understanding of this specification and the annexed drawings. While a particular feature may have been disclosed with respect to only one of several implementations, such a feature may be combined with one or more other features of the other implementations as may be desired and advantageous for any given or particular application.

The terminology used herein is for the purpose of describing particular embodiments only and is not intended to be limiting to this Disclosure. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

I claim:

1. A magnetically driven tool, comprising:

a shaft having a bottom application end including a contacting surface;

at least one support around a portion of said shaft for supporting components positioned outside said shaft and floating with respect to said shaft;

a first magnet within said support affixed to said shaft;

an electromagnet positioned outside said shaft and floating with respect to said shaft above said first magnet;

at least one bearing contacting said shaft for sliding said shaft in an axial direction;

wherein a direction of current through said electromagnet is applied so that like poles relative to said first magnet face one another during pushing operations and unlike poles face one another during pulling operations, and wherein a magnitude of said current sets a force applied by said contacting surface to a workpiece, and a force sensor outside said shaft on either side of said electromagnet without a fixed attachment to said shaft, wherein a force resulting from a magnetic field generated by said first magnet sensed by said force sensor provides a force measurement of said force applied by said contacting surface to said workpiece.

2. The tool of claim 1, wherein said at least one bearing comprises upper bearings attached to said support above said electromagnet and lower bearings attached to said support below said first magnet, wherein said support comprises a housing that encloses at least said upper bearings and said lower bearings, and wherein both a top end and bottom end of said shaft are physically unconnected, and wherein said upper bearings and lower bearings enable said shaft to rotate in an x-y plane.

3. The tool of claim 1, wherein said first magnet comprises a first permanent magnet.

4. The tool of claim 1, wherein said first magnet comprises an electromagnet.

5. The tool of claim 2, further comprising a second magnet between said first magnet and said lower bearings outside said shaft and floating with respect to said shaft, wherein said first magnet and said second magnet are positioned so that like poles face one another.

6. The tool of claim 5, wherein said first magnet comprises a permanent magnet and said second magnet comprises a permanent magnet.

7. The tool of claim 1, further comprising a position sensor coupled to said shaft.

8. The tool of claim 2, wherein said contacting surface comprises an attachment comprising a knife attached to said bottom application end.

9. The tool of claim 1, further comprising a control device coupled to said support for rotating said shaft.

10. The tool of claim 9, wherein said control device comprises a computer controlled robot.

11. The tool of claim 2, further comprising a control device coupled to said housing, wherein said control device comprises a computer controlled robot that includes a processor programmed to provide said current for a predetermined maximum cut force, and stored data including a pressure versus depth curve for at least one material in said workpiece.

12. A magnetically driven tool, comprising:

a shaft having a bottom application end including a contacting surface;

at least one housing around a portion of said shaft for supporting components positioned outside said shaft and floating with respect to said shaft;

a first permanent magnet within said housing affixed to said shaft;

an electromagnet secured to said housing positioned outside said shaft and floating with respect to said shaft above said first permanent magnet;

a second permanent magnet between said first permanent magnet and said lower bearings outside said shaft and floating with respect to said shaft, wherein said first permanent magnet and said second permanent magnet are positioned so that like poles face one another;

upper bearings attached to said support above said electromagnet and lower bearings attached to said support below said first permanent magnet, said upper and lower bearings for sliding said shaft in an axial direction;

wherein for pushing operations a direction of current through said electromagnet is applied so that like poles relative to said first permanent magnet face one another and unlike poles face one another during pulling operations, and a magnitude of said current sets a force applied by said contacting surface to a workpiece;

a position sensor coupled to said shaft, and a force sensor outside said shaft on either side of said electromagnet without a fixed attachment to said shaft, wherein a force resulting from a magnetic field generated by said first magnet sensed by said force sensor provides a force measurement of said force applied by said contacting surface to said workpiece.

13. A method of controlling an axial position of a contacting surface of a tool including a shaft while performing a process on a workpiece, comprising:

providing said shaft having a bottom application end including said contacting surface, a first magnet affixed to said shaft, an electromagnet floating on said shaft on a first side of said first permanent magnet, a force sensor outside said shaft on either side of said electromagnet without a fixed attachment to said shaft, wherein a force resulting from a magnetic field generated by said first magnet sensed by said force sensor provides a force measurement of said force applied by said contacting surface to said workpiece;

supplying current to said electromagnet so that like poles relative to said first magnet face one another during pushing operations and unlike poles face one another during pulling operations, wherein a magnitude of said current during said pushing operations sets a magnitude of said force applied by said contacting surface to perform said process to said workpiece, and based on said force measurement, using electronic control to regulate said force applied by said contacting surface to said workpiece.

14. The method of claim 13, wherein said providing further includes providing a second magnet between said first magnet and a side opposite said first side that floats on said shaft, wherein said first magnet and said second magnet are positioned so that like poles face one another.

15. The method of claim 14, wherein said first magnet comprises a permanent magnet and said second magnet comprises a permanent magnet.

16. The method of claim 13, further comprising sensing an axial position of said shaft, and controlling said axial position of said shaft based on said sensing said axial position and said force applied by said contacting surface to said workpiece.

17. The method of claim 13, further comprising rotating said shaft using a computer controlled device that is coupled to said shaft.

18. The method of claim 17, wherein said computer controlled device comprises a computer controlled robot.

19. The method of claim 18, wherein said computer controlled robot includes a processor programmed to provide said current for a predetermined maximum cut force, and stored data including a pressure versus depth curve for at least one material in said workpiece.

20. The method of claim 19, wherein said workpiece comprises a coating over an edge of an optical window, wherein said contacting surface comprises an attachment comprising a knife attached to said bottom application end, and wherein said process comprises cutting said coating.

* * * * *